United States Patent [19]

Toedtli

[11] 4,161,086

[45] Jul. 17, 1979

[54] CONTINUOUS SHOT-BLASTING MACHINE

[75] Inventor: Sergej Toedtli, Schaffhausen, Switzerland

[73] Assignee: Georg Fischer Aktiengesellschaft, Schaffhausen, Switzerland

[21] Appl. No.: 814,847

[22] Filed: Jul. 11, 1977

[30] Foreign Application Priority Data

Jul. 13, 1976 [CH] Switzerland ..... 8995/76

[51] Int. Cl.[2] ..... B24C 3/10

[52] U.S. Cl. ..... 51/418; 134/62; 198/403; 198/472; 198/690

[58] Field of Search ..... 51/417–420; 134/43, 62; 198/403, 472, 404, 412, 648, 690; 214/1 Q, 1 QG

[56] References Cited

U.S. PATENT DOCUMENTS

| | | | |
|---|---|---|---|
| 2,940,614 | 6/1960 | Carlsson | 198/412 X |
| 3,165,196 | 1/1965 | Alfredeen | 198/690 |
| 3,759,366 | 9/1973 | Adank | 198/412 |
| 3,813,817 | 6/1974 | Häberlin | 51/419 |
| 3,852,919 | 12/1974 | Baughman | 51/419 |
| 3,880,273 | 4/1975 | Kaplan | 198/690 X |
| 3,957,163 | 5/1976 | Tanzler | 214/1 QG |

FOREIGN PATENT DOCUMENTS

| | | | |
|---|---|---|---|
| 2054761 | 7/1971 | Fed. Rep. of Germany | 51/419 |

*Primary Examiner*—Gary L. Smith

*Attorney, Agent, or Firm*—Toren, McGeady and Stanger

[57] ABSTRACT

A continuous shot-blasting machine for surface treating arbitrarily arranged batches of workpieces includes at least one blasting chamber for shot-blasting the workpieces and a turn-over device for turning over the workpieces to expose all surfaces for treatment. A pair of supporting racks carry the workpieces along a conveyor to and from the blasting chamber. The workpieces are carried on one of the supporting racks through the chamber for blasting treatment of their exposed surfaces and after being turned over are carried on the other supporting rack through the same chamber or through a second chamber for blasting treatment of the newly exposed surfaces. The turn-over device rotates the first supporting rack and workpieces through 180 degrees about a substantially horizontal axis after the first shot-blasting treatment to turn the workpieces over for deposit onto the other supporting rack. The turn-over device includes electromagnetic or hydraulic members for holding the workpieces on the supporting rack during the turning operation, and for releasing the workpieces from the supporting rack after being turned over to expose the untreated surfaces.

14 Claims, 9 Drawing Figures

8'
1
A
7
2,2'
8
3

8'
9'
3
7'
7
8
9
3
12

5
12
2'
2
9'
9
4'
4
11
5'
10
6

Fig.6
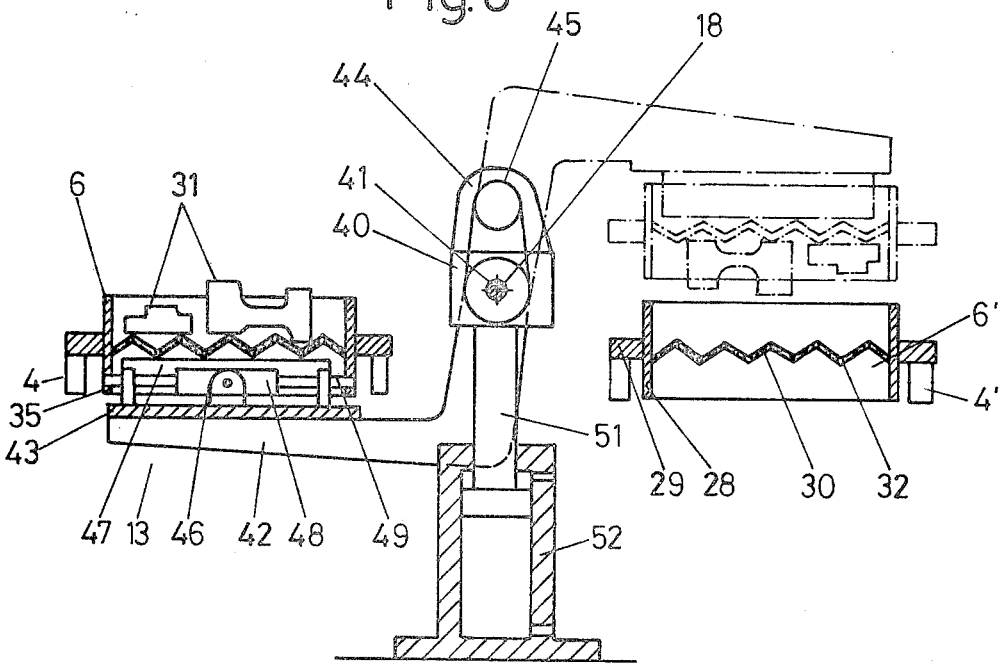
Fig. 7
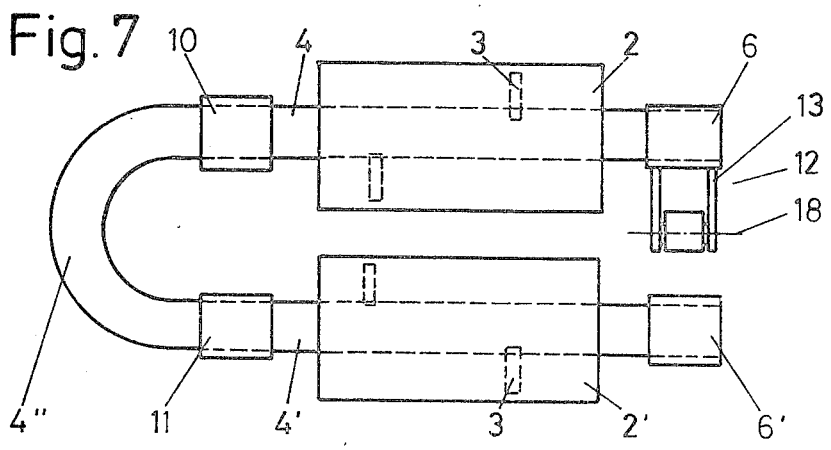
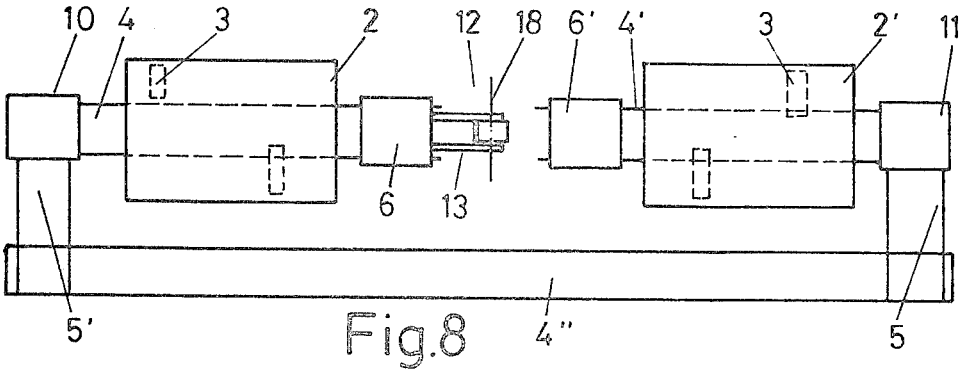
Fig.8

CONTINUOUS SHOT-BLASTING MACHINE

BACKGROUND OF THE INVENTION

The present invention relates generally to continuous shot-blasting machines for surface treating arbitrary arrangements of batches of workpieces which are carried on a conveyor device and, more particularly, to such shot-blasting machines which includes means for turning or rotating the workpieces so that all surfaces can be exposed to the shot-blasting treatment.

Shot-blasting machines which include devices or means for turning the workpieces over or causing them to otherwise rotate in order to expose all surfaces of the workpieces to proper surface treating are, of course, known in the art. One such known shot-blasting machine is shown and described in British Patent Specification No. 778,848 in which the workpieces to be treated are carried in batches on a revolving conveyor belt and are circulated or turned over for surface treatment of all sides of the workpieces by the up and down movement of rollers in a trough which carry the workpieces. After the blasting operation, the workpieces are conveyed to a delivery station by lowering the rollers which operate in the trough to the level of a horizontal conveyor belt for transporting the workpieces.

This type of shot-blasting machine is particularly suited for surface treating workpieces, all of which have the same uniform shape but is unsuitable for treating batches of workpieces with different or non-uniform shapes. A further disadvantage of this type of shot-blasting machine is that the turning of the various workpieces occurs irregularly so there is no way to insure that each workpiece will be turned by the same amount for receiving the same surface treatment on all sides.

Another type of blasting machine using a device for turning the workpieces is shown in U.S. Pat. No. 2,565,341 which includes a drum shaped cage for carrying the workpieces to be treated. The cage is arranged on rails for rotatable movement through a sand-blasting chamber. During the rotatable movement the workpieces are caused to circulate or otherwise tumble within the cage. This type of device also suffers from the disadvantages mentioned above and further has a limited capacity since a new batch of workpieces can only be treated when a preceeding batch has been removed from the cage.

It is accordingly one object of the present invention to provide a shot-blasting machine having means for rotating the workpieces to be treated which overcomes the disadvantages of the prior art.

It is a further more specific object of the present invention to provide a shot-blasting machine for the continuous treating of arbitrarily arranged workpieces having a means for turning over each workpiece regardless of its shape so that each of its surfaces is exposed for uniform treatment.

Yet another object of the present invention is to provide a shot-blasting machine of the foregoing type which can be continuously operated rendering it capable of being integrated into a plant or system for automatically molding and casting workpieces.

Still another object of the present invention is to provide a shot-blasting machine which uniformly treats all of the surfaces of arbitrarily arranged workpieces regardless of their shape or configuration.

Other objects, features, and advantages of the present invention will become more apparent from the detailed description of the invention in connection with the drawings to be described more fully hereinafter.

SUMMARY OF THE INVENTION

The foregoing objects are generally accomplished by providing a continuous shot-blasting machine for surface treating an arbitrary arrangement of workpieces which includes at least one blasting chamber for shot-blasting the workpieces, and at least one turn-over device for turning the workpieces over to expose untreated surfaces for uniform shot-blasting treatment. A pair of supporting racks are provided for carrying the workpieces and conveyor means are arranged for transporting the racks with the workpieces to and from the chamber. The turn-over device includes means for temporarily holding the workpieces on one supporting rack, and for releasing the workpieces from the rack after rotation for exposure of the untreated surfaces.

Preferred examples of the present invention will be more specifically described with reference to the accompanying drawings annexed hereto.

BRIEF DESCRIPTION OF THE DRAWINGS

In the drawings:

FIG. 6 is a sectional view of another type of turning or rotating device which may be used in the continuous shot-blasting machine according to the present invention;

FIG. 7 is a schematic top plan view of a continuous shot-blasting machine using the rotating device shown in FIG. 6;

FIG. 8 is a schematic plan view of a further continuous shot-blasting machine also using the rotating device according to FIG. 6.

DESCRIPTION OF THE INVENTION

Figure 1:
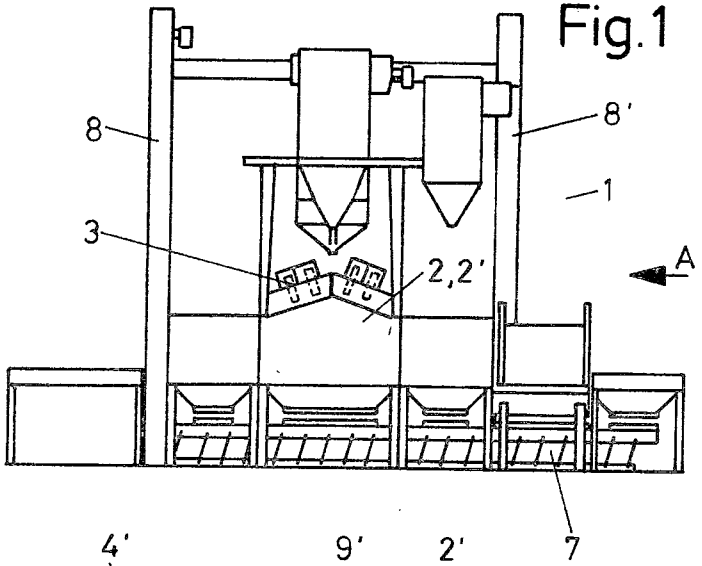
FIG. 1 is a front elevational view of one embodiment of the continuous shot-blasting machine according to the present invention.
Figure 2:
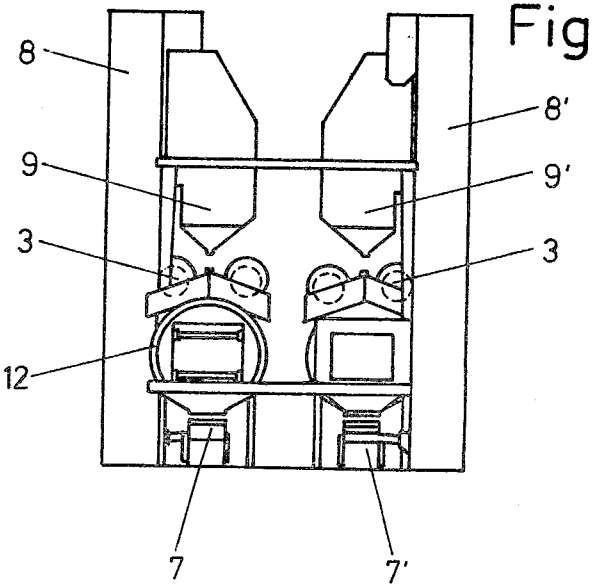
FIG. 2 is a side elevational view of the shot-blasting machine shown in FIG. 1 as seen in the direction of arrow A.
Figure 3:
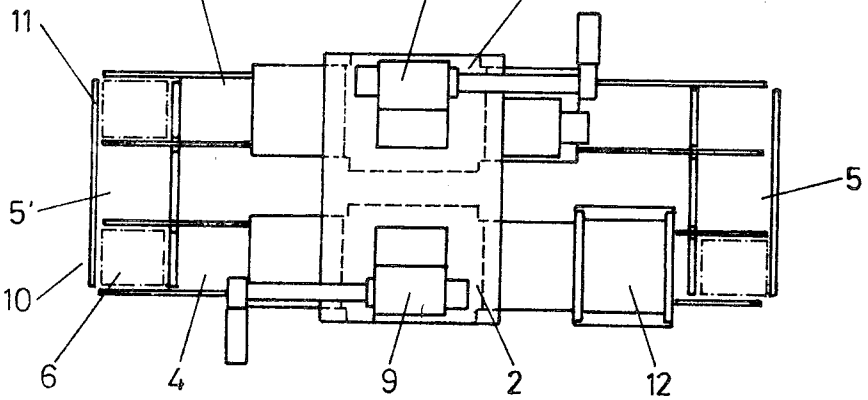
FIG. 3 is a top plan view of the continuous shot-blasting machine shown in FIG. 1.

Referring now in more detail to the accompanying drawings, FIGS. 1–3 illustrate a continuous blasting machine 1 having two separate blasting chambers 2 and 2′ arranged in side by side relation. Each of the blasting chambers is provided with blowers 3 for use in the blasting operations. Supply devices 9 and 9′ are associated with each of the chambers 2 and 2′ respectively for supplying blasting medium. Conveyor devices 7 and 7′ are located under each of the blasting chambers and are operatively connected with the supply devices 9 and 9′ through bucket conveyors 8 and 8′ respectively.

Roller conveyors 4 and 4′ have supporting rollers for transporting the workpieces to and through each of the blasting chambers 2 and 2′ respectively. In the embodiment shown in FIGS. 1–3, conveyors 4 and 4′ are arranged parallel to each other. The opposite ends of the conveyors 4 and 4' are interconnected by two additional roller conveyors 5 and 5' (also having supporting rollers) which extend in a direction generally transverse to the direction of movement of the workpieces on conveyors 4 and 4'. Thus, an endless conveyor system including conveyors 4, 5, 4', and 5' are used for transporting workpieces through the blasting chambers. Supporting racks 6 and 6' are used for carrying the workpieces on the conveyors and through the blasting chambers.

The conveyors can be formed either by a continuous surface of adjacent rollers, or by a pair of spaced roller tracks for supporting the racks 6.

A loading station 10 is positioned at one end of the conveyor 4 for receiving workpieces on the supporting rack 6 for transport first through the blasting chamber 2 and then to and through the blasting chamber 2'. An unloading station 11 is positioned at an end of the roller conveyor 4' where the treated workpieces may be removed from the conveyor system after passing through both blasting chambers. A turn-over device, indicated generally as reference numeral 12, is located at the outlet side of the blasting chamber 2 for turning the workpieces over after they have passed through the first chamber 2 to expose surfaces untreated in chamber 2 for subsequent sand-blasting treatment in chamber 2'.

Figure 4:
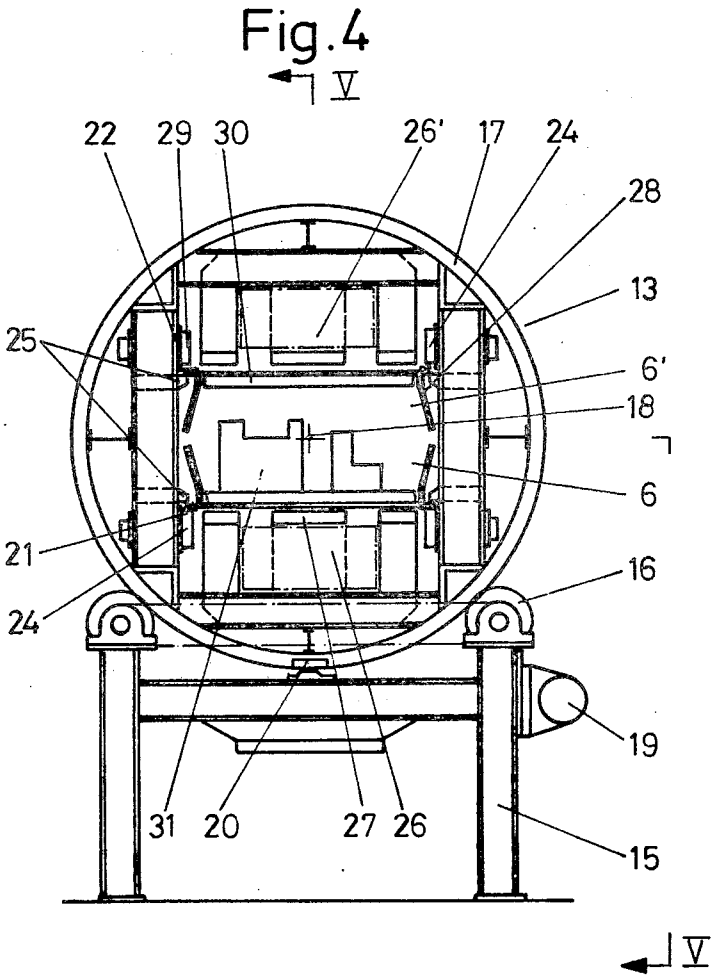
FIG. 4 is an enlarged side elevational view of a turning or rotating device used in the embodiment of the continuous shot-blasting machine shown in FIGS. 1–3.
Figure 5:
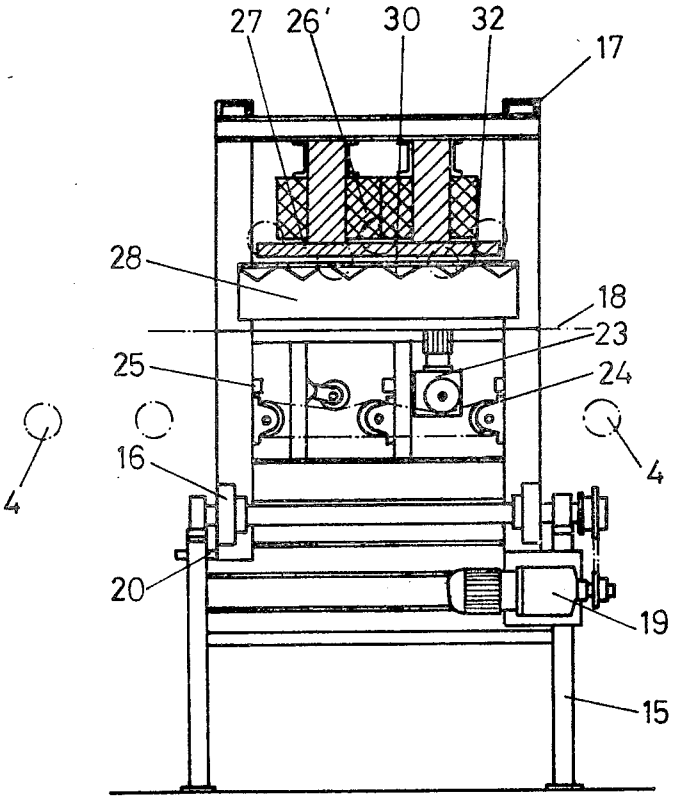
FIG. 5 is a sectional view taken along lines V—V of FIG. 4.

FIGS. 4 and 5 illustrate one type of turn-over device which could be used in the continuous blasting machine 1 of FIGS. 1–3. The turn-over device 12 has a rotating assembly 13 supported on a frame 15 which carries four rollers 16 rotatably mounted thereon. A gear motor 19 is also carried by frame 15 for rotatably driving rollers 16. The assembly 13 includes a rotating frame 17 supported on the rollers 16 for rotatable movement about a horizontal axis 18. The rotatable movement of the frame 17 is accomplished by energizing the motor 19 to drive the rollers 16. Two of the rollers 16 are driven by the use of an appropriate chain drive arrangement coupled to motor 19. The frame 17 is additionally guided in the axial direction of the frame by two rollers 20 carried on the supporting frame 15.

The rotating frame 17 carries two separate roller tracks 21 and 22 symmetrically spaced relative to the horizontal axis 18. Except during the turn-over operation, one of the tracks 21 or 22 is always aligned in the same plane with the supporting surfaces of the roller conveyor 4. A rack 6 carrying workpieces 31 can thus be transported directly from the conveyor 4 into the rotating frame 17 and on to one of the roller tracks 21 or 22. The other roller track will be positioned directly above the roller track in the same horizontal plane with the conveyor 4. Each of the roller tracks 21 and 22 includes rollers 24 for supporting and moving the supporting rack carrying the workpieces from the conveyor 4 into the frame 17 of the rotating assembly 13 and for delivering the supporting rack from the turn-over device after the turning operation back on to the conveyor 4. A gear motor 23 is associated with each of the tracks 21 and 22 for driving the rollers 24.

To accomplish the turn-over operation, a first supporting rack 6 carrying workpieces 31 is transported on conveyor 4 and delivered into the frame 17 on track 21 with supporting rack 6 resting on the rollers 24. A second supporting rack 6' is already positioned on track 22 of the frame 17 in inverse position above supporting rack 6. Elements 25 are arranged on the rotating frame 17 in spaced apart relation to the rollers 24 thus forming a guide track with the rollers 24 for the passage of the supporting racks. The second supporting rack 6' will rest on the elements 25 and thus be in a position to receive the workpieces 31 when the turn-over device is rotated about axis 18.

The supporting racks 6 and 6' have a frame 28 and ledges 29 which support the rack either on the rollers 24 when in an upright position or on elements 25 when in the inverse position. The ledges also serve to support the rack on the tracks of the conveyors as it is transported through the blasting chambers. Each of the supporting racks has a support surface 30 carried by the frame 28 on which the workpieces 31 will be supported. The support surface 30 preferably has a triangular saw-tooth cross sectional shape to provide a ricochet effect for the blasting medium during the blasting operation. Slots 32 are located at the bottom of the valleys of the triangular saw-tooth surface so that the blasting medium with the blasted sand or scale from the workpieces can fall through the slots onto the conveyor devices 7 and 7' of each of the blasting chambers.

Means are also provided for insuring that the workpieces 31 are held in position on its supporting rack during rotation of the rotating frame 17 until they are turned over. In the embodiment shown in FIGS. 4 and 5 this is accomplished by providing electromagnets 26 and 26' each mounted on the frame 17, and each having pole pieces 27 positioned very close to the bottom or back surface of the supporting racks 6 and 6' respectively when the racks are in position in the tracks 21 and 22 respectively. Each of the supporting racks 6 and 6' are preferably made of non-magnetic, wear-resistant material, such as austenitic manganese steel. The magnetic forces generated by the electromagnets therefore hold the workpieces on the nonmagnetic rack.

The continuous blasting machine 1 shown in FIGS. 1–3 with the turn-over device 12 operates as follows. Workpieces 31 are delivered in groups or batches such as from an automatic molding and casting operation, and are loaded onto supporting racks 6 at the loading station 10 on roller conveyor 4 for transport through the continuous blasting machine. The workpieces can be of different configurations, such as illustrated in FIG. 4, and can be arbitrarily arranged on the supporting rack 6. The supporting rack and workpieces are transported through the first blasting chamber 2 in which the exposed surfaces of the workpieces receive the blasting treatment. From the chamber 2 the supporting rack is delivered to the turn-over device 12 shown in FIG. 4. Initially, the rack 6 is received on the roller track 21 and an empty supporting rack 6' is carried in the upside down position on the roller track 22 above the supporting rack 6. In order to turn the workpieces over, electromagnets 26 positioned beneath the roller track 21 will be energized and the workpieces 31 will be firmly held on the support surfaces 30 as a result of the generated magnetic forces. In this manner the workpieces will remain in secure position with respect to the supporting rack 6 during the turning operation.

After a locking device (not shown herein) for locking frame 17 has been released, rollers 16 are driven by gear motor 19 to rotate the frame 17 through 180 degrees about the horizontal axis 18. After 180 degrees rotation, supporting rack 6 carrying workpieces 31 will be in a position previously occupied by supporting rack 6', and supporting rack 6' carried in the roller track 22 will be in the position previously occupied by supporting rack 6 carried in track 21. Track 22 is then in the same horizontal plane with the supporting surface of the conveyor 4 and the locking device is reapplied to relock the frame 17. Electromagnet 26 is de-energized and the workpieces 31 are allowed to fall downwardly from supporting rack 6 onto the support surface 30 of the subjacent supporting rack 6', thus exposing the untreated surfaces of the workpieces. The workpieces are still arbitrarily arranged on the supporting rack 6' but their previously untreated surfaces are now available for uniform sand-blasting treatment.

The supporting racks 6' carrying the turned over workpieces are delivered from the frame 17 onto the roller conveyor 4, by energizing motor 23 to drive the rollers 24. Supporting rack 6' is transported by conveyor 4 onto conveyor 5 and then onto conveyor 4' for delivery into the second sand-blasting chamber 2' where the previously untreated surfaces of the workpieces are sand-blasted. After the second blasting treatment in chamber 2', the supporting rack 6' with the finish blasted workpieces are delivered to the unloading station 11 where they are unloaded from the conveyor system. The empty supporting rack 6' is then delivered by roller conveyor 5' to the loading station 10 where a new load of untreated workpieces are arranged on the empty supporting rack to begin a new cycle.

Figure 9:
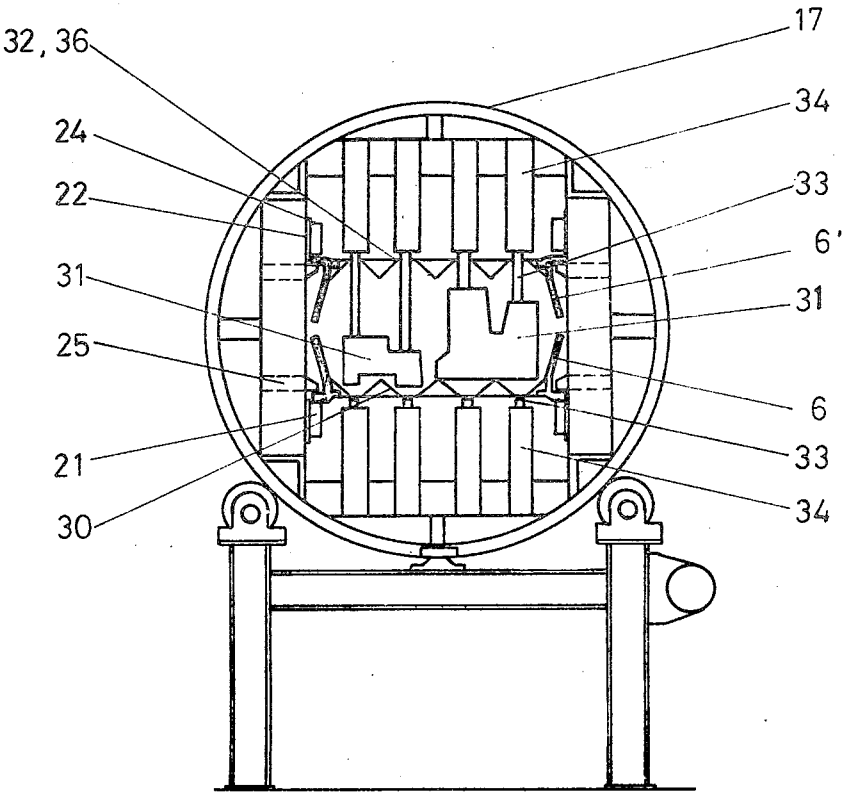
FIG. 9 is an enlarged elevational view showing still a further embodiment of a rotating device similar to that shown in FIG. 4.

FIG. 9 illustrates an embodiment of a turn-over device, similar to that shown in FIG. 4, but having different means for holding the workpieces in position against its supporting rack during the rotating operation. Instead of using electromagnetic devices to hold the workpieces in position through magnetic forces, a plurality of hydraulic or pneumatic cylinders 34 with plungers 33 are provided. To accommodate the plungers 33, supporting racks 6 and 6' have openings 36. Slots 32 are enlarged to permit passage of the plungers 33. Extending the slots 32 in a direction parallel to the movement of the supporting racks also has the advantage that it allows some longitudinal movement of the racks while the plungers are in the extended position.

To operate the turn-over device shown in FIG. 9, a supporting rack 6 with workpieces is received on the track 21. Hydraulic cylinders 34, arranged above the supporting rack 6' in track 22, are pressurized to extend plungers 33 through the slots 32 and openings 36 in the supporting rack 6' until they come in contact with and engage surfaces of the workpieces 31 carried on the supporting rack 6. The hydraulic pressure of the cylinders causes the plungers to press the workpieces 31 against the supporting surface 30 of the rack 6 and to hold the workpieces firmly in place during the rotating operation. The frame 17 is rotated through 180 degrees in a manner previously described until the supporting rack 6 with the workpieces are turned over into the position previously occupied by supporting rack 6'. Workpieces 31 are deposited on supporting rack 6' by withdrawing plungers 33 from the extended position and allowing the workpieces to be lowered unto the waiting rack 6'. The workpieces are thus turned over exposing untreated surfaces for subsequent shot blasting treatment. Then the supporting rack 6' with the turned over workpieces is transported by rollers 24 onto the conveyor 4 for subsequent transport via conveyors 5 and 4' to the second blasting chamber.

A turn-over device made in accordance with the embodiment shown in FIG. 9 is of advantage, since the supporting racks do not necessarily have to be made out of non-magnetic material, as is the case of the turn-over device in the embodiment of FIG. 4. Additionally, the turned over workpieces can be lowered onto the waiting supporting rack at any desired speed so that possible damage to the workpieces by dropping a small distance can be avoided.

FIG. 6 illustrates another embodiment of the turn-over device particularly suitable for use in the continuous shot-blasting machines arranged as shown in FIG. 7 or 8. This type of turn-over device includes a hydraulic or pneumatic cylinder 52 with a connection for a source of operating fluid such as compressed air to drive a piston rod 51. The end of the piston rod 51 carries a rotating assembly 13, which includes bearing block 40 for supporting a horizontally extending shaft 41. A lever 42 for turning over the racks of workpieces is carried on the shaft 41. The lever is formed of an L-shaped arm connected to the shaft 41. A support plate 43 is carried on the lever 42. A gear drive motor 44 is carried on the bearing block 40 and a chain drive 45 couples the motor to the shaft 41 over appropriate sprocket wheels for rotatably driving the shaft 41. In this manner, by rotating the shaft 41 through 180 degrees about its horizontal axis 18 the lever 42 carrying the support plate 43 (is rotated in a clockwise direction as seen in FIG. 6) through 180 degrees to turn over a support rack and workpieces carried on the support plate.

The supporting rack 6 and 6' can be securely held on the supporting plate during the turn-over operation by a clamping device 46 which is mounted on the supporting plate 43. Clamping device 46 consists of a pair of hydraulic or pneumatic cylinders 48 having piston rods 49 arranged to be extended for engagement with recesses 35 provided in the racks 6 and 6'. Electromagnets 47 can also be positioned between the hydraulic or pneumatic cylinders 48 for holding the workpieces 31 on the supporting rack 6 during the turn-over operation. When a supporting rack carrying workpieces is in proper position for being turned over, the cylinders 48 are energized to extend the piston rods 49 into the recesses 35 of the support racks and the electromagnets 47 are energized to hold the workpieces 31 on the rack. Drive motor 44 is then energized to rotate the shaft 41 and the "L" shaped lever 42 about the axis 18 from the position shown in solid lines to the turned over position shown in broken lines.

Because of the "L" shaped configuration of the lever 42, the turned over rack is at a position which is somewhat higher than desirable for dropping the workpieces onto the supporting rack 6' resting on the conveyor 4'. The turned-over rack can be lowered by operating the cylinder 52 in reverse direction so that piston rod 51 is withdrawn into the cylinder. The use of the cylinder 52 and piston rod 51 to raise and lower the turned over rack is particularly useful for transferring empty racks from one conveyor to another. This capability, however, requires the use of reversible support racks. One such type of reversible support rack 6 and 6' is shown in FIG. 6. This rack has substantially straight side walls 28 with a triangular type saw-tooth support surface 30 extending between the side walls 28 and located midway between the height of the side walls 28. Ledges 29 extend outwardly from the side walls 28 to support the rack on the tracks of the roller conveyors of the shot-blasting machine. This type of supporting rack can, therefore, be used to support work-pieces on either side of the support surface 30 and is, accordingly completely reversible.

The turn-over device shown in FIG. 6 can be somewhat simplified by eliminating the cylinder 52 and piston rod 51. This, however, would require the use of conveyors at different levels on opposite sides of the turn-over device, or would require additional means for raising and lowering that portion of the conveyor adjacent the turn-over device for transferring the supporting racks between the conveyor and the turn-over device supporting plate.

FIG. 7 schematically illustrates a continuous shot-blasting machine having a conveyor system suitably designed for use with the turn-over device shown in FIG. 6. Like reference numerals are used to designate those elements previously described with respect to the embodiment shown in FIGS. 1–3. Accordingly, the shot-blasting machine shown in FIG. 7 includes two separate blasting chambers 2 and 2' with blowers 3. Conveyors 4 and 4' extend in parallel directions through the chambers 2 and 2' respectively. A loading station 10 is positioned at one end of conveyor 4 and an unloading station 11 is positioned at a corresponding end of conveyor 4'. A turn-over device 12 with rotating assembly 13 for rotating the workpieces about a horizontal axis 18, which extends in a direction parallel to the direction of travel of the workpieces on conveyors 4 and 4', is positioned between conveyors 4 and 4' at the ends opposite the loading and unloading stations. Chambers 2 and 2' are located between the loading and unloading stations, respectively, and the turn-over device 12. A curved conveyor 4'' connects the ends of the conveyors 4 and 4' between the loading and unloading stations.

In operation, supporting racks 6 positioned at the loading station 10 are loaded with workpieces 31 and then transported on roller conveyor 4 through blasting chamber 2 where the workpieces receive a first blasting treatment. The supporting rack 6 with workpieces 31 exits the chamber 2 and is delivered to a position at the end of conveyor 4 (to the right of chamber 2 as seen in FIG. 7) directly above the support plate 43 of the turn-over device 12. The clamping device 46 is then operated to clamp or secure the supporting rack 6 on the turn-over device. Electromagnets 47 are energized to secure the workpieces 31 on the support rack 6. Drive motor 44 is then energized and the "L"-shaped lever 42 is rotated through 180 degrees about the axis 18 causing the loaded support rack 6 to be turned over. The "L"-shaped configuration of the rotating assembly will cause a displacement of the rack in a direction transverse to the axis 18 into a position directly above the end of conveyor 4' (to the right of chamber 2' as seen in FIG. 7). An empty supporting rack 6' is positioned at the end of conveyor 4' to receive the treated workpieces from the turned-over rack 6. If desirable, the turned over levers 42 are lowered through the use of cylinder 52 and piston rod 51 to prevent the workpieces 31 from falling from too great a distance. Thereafter, the electromagents 47 are de-energized to release the workpieces 31 from the rack 6 for deposit onto the waiting rack 6', thus exposing untreated surfaces of the workpieces for further shot-blasting treatment in the chamber 2'. After the transfer, the support rack 6' with turned over workpieces 31 is transported on conveyor 4' through the second blasting chamber 2' and then to the unloading station 11 where the fully treated workpieces may be off-loaded.

After transferring the workpieces from turned over rack 6 to waiting rack 6' and transport of the rack 6' through the chamber 2' to the unloading station 11, the turned over empty rack 6, which is still clamped to the supporting plate 43 of the turn-over device 12, can be lowered onto the empty end of the conveyor 4' and released from the turn-over device 12 by unclamping the clamping device 46. Since the supporting rack is reversible, it will now be in position for receiving the next batch of turned over workpieces from the turn-over device 12. The empty turn-over device 12 is then returned to its initial position to receive the next supporting rack with workpieces from the blasting chamber 2. The empty supporting racks at the unloading station 11 can be automatically transported to the loading station 10 along curved conveyor 4'' to receive a new batch of untreated workpieces.

FIG. 8 illustrates a further embodiment of a continuous shot-blasting machine also having two blasting chambers 2 and 2' which are arranged in tandem rather than in parallel as in the embodiment of FIG. 7. Similarly, conveyors 4 and 4' are used for conveying supporting racks with workpieces through the chambers 2 and 2', respectively, and a turn-over device 12 is positioned between adjacent ends of the conveyors 4 and 4'. In the embodiment of FIG. 8, however, the axis of rotation 18 of the turn-over device is arranged in a direction perpendicular to the direction of travel along conveyors 4 and 4', rather than being arranged parallel thereto as in the embodiment of FIG. 7.

Loading station 10 is positioned on one side of the blasting chamber 2 and unloading station 11 is positioned on the other side of blasting chamber 2', unlike the situation in FIG. 7 where both loading and unloading stations are positioned on the same side of the chambers 2 and 2'.

The turn-over device 12 used in the arrangement of FIG. 8 is identical to that of FIG. 6 and to that used in FIG. 7 and operates in substantially the same manner. However, the simultaneous turn-over and displacement of the supporting rack 6 from conveyor 4 to conveyor 4' is in a direction parallel to the direction of travel rather than in a direction transverse thereto as is the situation in FIG. 7.

Accordingly, workpieces are loaded on empty support racks at the loading station 10, transported along conveyor 4 through chamber 2 and turned over by the turn-over device 12 to transfer the treated workpieces to a waiting empty rack 6' for transport along conveyor 4' through chamber 2' and to the unloading station 11. In a manner similar to that described with respect to FIG. 7, the emptied racks 6 may be deposited on the empty end of conveyor 4', and the empty rack at the unloading station 11 may be transported back to the loading station 10 on the series arranged conveyors 4, 4'' and 5'.

It will be appreciated from the foregoing that a novel shot-blasting machine for continuous operation, including a means for turning over the workpieces so that all surfaces can be uniformly treated, has been provided which has significant advantages over the prior art. For example, it should be noted that the use of the electromagnets for holding the workpieces on the supporting rack during the turn-over operation makes it possible to turn over workpieces having different shapes and configurations in a very simple and efficient manner insuring that the untreated surfaces of each of the workpieces, regardless of their shape, will be exposed for subsequent treatment.

Various modifications may also be made to the present invention in order to achieve various degrees of versatility. For example, in order to subject the workpieces to several blasting treatments using different sand grains for each of the treatments, several turning devices may be used with additional blasting chambers and appropriately arranged conveyor systems. Each of the turning devices would be provided with means for temporarily retaining the workpieces on a supporting rack and with means for turning the rack together with the workpieces 180 degrees about a horizontal axis.

Another modification of the present invention which would make the invention particularly attractive for low-cost and low-power systems would be to provide only a single blasting chamber with a single conveyor extending through the blasting chamber. The loading and unloading station would be positioned on the inlet side of the chamber and the turn-over device would be positioned on the outlet side of the chamber. One side of the workpieces would be treated during a first pass through the chamber and the other side would be treated during a return or subsequent pass through the same chamber after the workpieces have been rotated through 180 degrees by a turn-over device preferably made in accordance with the embodiment shown in FIG. 6 and having an axis of rotation extending generally at right angles to the direction of transport through the chamber.

Because the present invention includes means which are capable of turning over the workpieces very rapidly, the capacity for treating workpieces in the continuous shot-blasting machine of the present invention can be compatible with the output capacity of the present day automatic molding and casting operations by merely using the proper number of revolving supporting racks and employing a sufficient number of blowers within the blasting chambers.

While the invention has been described and illustrated with respect to certain embodiments which produce satisfactory results, it will be appreciated by those skilled in the art, after understanding the purposes of the invention, that various additional changes and modifications may be made without departing from the spirit and scope of the invention, and it is therefore intended in the appended claims to cover all such changes and modifications.

What is claimed is:

1. A continuous shot-blasting machine for surface treating batches of workpieces comprising at least one blasting chamber for shot-blasting the workpieces, first and second supporting racks for carrying the workpieces through said chamber, conveyor means for transporting said supporting racks with the workpieces through said chamber, at least one turn-over device for rotating one of said first and second supporting racks with workpieces thereon through 180 degrees about a substantially horizontal axis, and means for temporarily securing the workpieces to said supporting rack being rotated during rotation of said supporting rack and for releasing the workpieces from said supporting rack to deposit the turned-over workpieces onto the other one of said first and second supporting racks so that untreated surfaces of the workpieces are being exposed for shot-blasting treatment.

2. The continuous shot-blasting machine according to claim 1 wherein said turn-over device comprises rotatably mounted support rollers, a rotating frame mounted on said support rollers for rotation about said horizontal axis, means for rotatably driving said support rollers to effect rotation of said frame, a pair of roller tracks carried by said frame in opposed symmetrical relationship to said axis, and means associated with each of said roller tracks to support said supporting racks, so that said racks can be rotated through 180 degrees as said frame is rotated by said support rollers.

3. The continuous shot-blasting machine according to claim 2 wherein said means for temporarily securing the workpieces to said supporting rack comprises at least one electromagnet carried by said turn-over device for generating a magnetic force to hold the workpieces on said supporting rack.

4. The continuous shot-blasting machine according to claim 3 wherein said means for temporarily securing the workpieces comprises at least two said electromagnets symmetrically positioned on opposite sides of said horizontal axis between said pair of roller tracks, pole pieces of said electromagnets being located in a position adjacent the rear surface of said supporting racks when said supporting racks are supported on said roller tracks.

5. The continuous shot-blasting machine according to claim 2 wherein said means for temporarily securing said workpieces to said supporting rack comprises a plurality of plungers extendably carried by said rotating frame for engaging the workpieces, and means for causing extension of said plungers to engage and hold the workpieces against said supporting rack.

6. The continuous shot-blasting machine according to claim 5 wherein said supporting racks are provided with openings of a size sufficient to accommodate said plungers so that said plungers can pass therethrough for engaging the workpieces.

7. The continuous shot-blasting machine according to claim 5 wherein two sets of plungers are symmetrically arranged on opposite sides of said horizontal axis and positioned between said pair of roller tracks for extension in a direction perpendicular to the direction of transport of said workpieces carried on said supporting racks.

8. The continuous shot-blasting machine according to claim 1 wherein said turn-over device comprises a support, a shaft rotatably mounted on said support, a lever secured to said shaft for rotation with said shaft about said horizontal axis, means carried by said lever for carrying said supporting racks, and means for clamping said supporting racks to said lever during the turn-over operation.

9. The continuous shot-blasting machine according to claim 8 further comprising means for raising and lowering said turn-over device so as to adjust the height of said support rack with respect to said conveyor means.

10. The continuous shot-blasting machine according to claim 8 comprising a first blasting chamber for shot-blasting the workpieces when in a first position, a second blasting chamber for shot-blasting the workpieces when in a turned over position with respect to said first position, said conveyor means comprising first and second parallel roller conveyors for transporting said supporting rack and workpieces through said first and second blasting chambers respectively, and said turn-over device being positioned between said parallel extending roller conveyors having its horizontal axis of rotation extending in a direction parallel to the direction of transport of the workpieces along said conveyors.

11. The continuous shot-blasting machine according to claim 8 comprising a first blasting chamber for shot-blasting said workpieces when in a first position, a second blasting chamber for shot-blasting the workpieces when in a turned over position with respect to said first position, said conveyor means comprising aligned first and second roller conveyors for transporting said supporting rack and workpieces through said first and second blasting chambers respectively, and said turnover device being positioned between said first and second conveyors having its horizontal axis of rotation extending in a direction perpendicular to the direction of transport of the workpieces along said conveyors.

12. The continuous shot-blasting machine according to claim 8 wherein said clamping means comprises first and second cylinders and piston rods, and recesses in said support racks engageable by said piston rods when extended from said cylinders.

13. The continuous shot-blasting machine according to claim 1 wherein said supporting racks are made of non-magnetic, wear-resistant austenitic manganese steel.

14. The continuous shot-blasting machine according to claim 1 wherein said support racks comprise a support surface having a triangular saw-tooth cross sectional configuration.

* * * * *